US009834350B1

(12) United States Patent
Jones

(10) Patent No.: US 9,834,350 B1
(45) Date of Patent: Dec. 5, 2017

(54) BOTTLE CONTENTS IDENTIFICATION SYSTEM

(71) Applicant: Jennifer Jones, Boca Raton, FL (US)

(72) Inventor: Jennifer Jones, Boca Raton, FL (US)

( * ) Notice: Subject to any disclaimer, the term of this patent is extended or adjusted under 35 U.S.C. 154(b) by 0 days.

(21) Appl. No.: 14/859,331

(22) Filed: Sep. 20, 2015

Related U.S. Application Data

(60) Provisional application No. 62/054,874, filed on Sep. 24, 2014.

(51) Int. Cl.

| | |
|---|---|
| ***B65D 51/20*** | (2006.01) |
| ***B65D 51/24*** | (2006.01) |
| ***B65D 23/14*** | (2006.01) |
| ***B65D 41/00*** | (2006.01) |

(52) U.S. Cl.
CPC ..... *B65D 51/245* (2013.01); *B65D 23/14* (2013.01); *B65D 41/005* (2013.01)

(58) Field of Classification Search
CPC .. B65D 51/245; B65D 47/06; B65D 2203/00; G09F 23/00; G09F 3/00; G09F 2023/0025; G09F 23/0091
See application file for complete search history.

(56) References Cited

U.S. PATENT DOCUMENTS 1,557,332 A * 10/1925 Robbins ..... G09F 1/04 40/312
1,905,927 A * 4/1933 Marsh ..... G09F 1/06 40/307
2,101,565 A * 12/1937 Snelling ..... G09F 1/04 29/407.09
3,037,310 A * 6/1962 Montalto ..... G09F 3/04 40/310
3,370,733 A * 2/1968 Giesler ..... B65D 73/0071 206/216
4,373,632 A * 2/1983 VanZandt ..... A47F 7/285 206/457
5,362,561 A * 11/1994 Lower ..... B65D 23/12 215/386
D369,550 S * 5/1996 Crosby ..... D9/435
7,055,680 B2 * 6/2006 Liebers ..... A45C 11/04 206/460
7,942,451 B2 * 5/2011 Adler ..... A61J 7/04 206/232
8,201,385 B2 * 6/2012 McLean ..... B32B 27/08 215/232

(Continued)

*Primary Examiner* — Cassandra H Davis
(74) *Attorney, Agent, or Firm* — Allen D. Hertz, P.A.; Allen D. Hertz

(57) ABSTRACT

An identification system for identifying contents within a bottle. The identification system introduces a label upon a sidewall of a cap of the bottle or as a billboard extending upward from a top surface of the cap. The location improves the visibility of the indicia located on the label easing the identification process when the bottles are placed behind one another, on a shelf above eye level or any other location where the view of the content identifying indicia can potentially be obstructed from view. The label can be wrapped about the cap sidewall, adhered to the cap sidewall or be designed to include an upright billboard extending from the cap top surface. The billboard variant can transform from a planar stored configuration to an upright display configuration.

19 Claims, 7 Drawing Sheets

(56) References Cited

U.S. PATENT DOCUMENTS

| | | | | |
|---|---|---|---|---|
| 2004/0205989 | A1* | 10/2004 | Michaels | G09F 3/14 40/310 |
| 2004/0216340 | A1* | 11/2004 | Woods | B65D 51/245 40/311 |
| 2005/0109725 | A1* | 5/2005 | Stewart | A61J 11/008 215/11.6 |
| 2009/0090688 | A1* | 4/2009 | Fruchter | B65D 51/245 215/230 |

* cited by examiner

BOTTLE CONTENTS IDENTIFICATION SYSTEM

CROSS-REFERENCE TO RELATED APPLICATION

This Non-Provisional Utility Patent Application claims the benefit of U.S. Provisional Patent Application Ser. No. 62/054,874 filed on Sep. 24, 2014, which is incorporated herein in its entirety.

FIELD OF THE INVENTION

The present invention relates to a spice bottle identification apparatus and method of use. More specifically, the spice bottle identification system employs an identifier that is provided in a form of a label, a billboard, or an elastic band, wherein each of the identifiers is secured to a cap of a spice bottle for ease of identification of contents of the spice bottle.

BACKGROUND OF THE INVENTION

Bottles are used for storing any of a variety of contents. Bottles can be stored in a variety of locations.

Spices are one example of an item that is commonly distributed and stored in bottles. Spices are derived from a dried seed, fruit, root, bark, or vegetable substance. Spices are primarily used for flavoring, coloring or preserving food. Spices are also used to hide other flavors.

Bottles containing spices are commonly stored in a pantry or upper cabinets of a kitchen. The spices are identified by a label that is adhesively attached to a sidewall of the bottle. The location of the label introduces a hardship to a person trying to locate a specific spice. Additionally, the sidewall of the bottles is normally the widest part of the bottle. When multiple spice bottles are stored adjacent to one another, the labels can be obscured hindering the process of identifying a specific spice. The labels may be rotated orienting the indicia away from the view of the individual. In a condition where the spice bottles are stored above eye level, the shelf can obscure a view of the labels from the individual. These and other factors impact the ability of the individual to locate one or more specific spices within a storage area.

It is understood that the same issues are associated with containers storing other items, compositions, and the like. http://en.wikipedia.org/wiki/Spice-cite_note-1

Accordingly, there remains a need in the art for a labeling system enabling visibility to an identifier of contents of a bottle when the bottle is located on an elevated supporting platform, such as a shelf.

SUMMARY OF THE INVENTION

The present invention overcomes the deficiencies of the known art by disclosing an apparatus and a method of use for identifying contents within a bottle, more specifically a spice, herb, or similar within a bottle.

In accordance with one embodiment of the present invention, the invention consists of a bottle contents identifying system comprising:

a bottle container;

a bottle cap removably attachable to the bottle in a manner to seal the bottle when closed and obtain access to contents within the bottle when removed;

a contents identification label; and indicia disposed upon a surface of the contents identification label, wherein the indicia identifies contents of the bottle;

wherein the contents identification label is attached to a sidewall of the cap of the bottle.

In a second aspect, the label is attached to the bottle cap using a bonding agent. The bonding agent can be an adhesive, glue, epoxy, double sided tape, and the like.

In another aspect, the label can be provided in a form of a continuous loop, wherein the continuous loop is sized for attachment to the sidewall of the cap of the bottle.

In another aspect, the label can be provided in a form of a continuous loop, wherein the continuous loop is sized for attachment to an upper region of the sidewall of the bottle.

In another aspect, the label can be provided in a form of a continuous loop, wherein the continuous loop is sized for attachment to a neck portion of the bottle.

In another aspect, the label can be provided in a form of a loop, wherein the loop is adjustable in size.

In yet another aspect, the label is fabricated of a material having elastic properties, such as rubber, elastic, and the like. The loop would be sized to employ the elastic properties to retain the label around a circumference of the sidewall of the cap of the bottle.

In yet another aspect, the indicia can be recessed within the material of the label.

In yet another aspect, the indicia can be formed as an embossing on the material of the label.

In yet another aspect, the indicia can be applied using a pliant ink or paint.

In accordance with a second embodiment of the present invention, the invention consists of a bottle contents identifying system comprising:

a bottle container;

a bottle cap removably attachable to the bottle in a manner to seal the bottle when closed and obtain access to contents within the bottle when removed;

a billboard identification assembly comprising:

an identifier base element, a billboard hingeably attached to the identifier base element, indicia disposed upon at least one surface of the billboard, wherein the indicia identifies contents of the bottle; and wherein the identifier base element is attached to a top surface of the cap of the bottle and the billboard is rotated into an orientation that is generally perpendicular to the top surface of the bottle.

In a second aspect, the billboard is retained in a generally perpendicular orientation by a support leg.

In another aspect, the support leg is hingeably attached to one side of the billboard.

In yet another aspect, the indicia is disposed upon both surfaces of the billboard.

In yet another aspect, the billboard identification assembly further comprises an adhesive applied to an attachment surface of the identifier base element.

In yet another aspect, a plurality of at least one of contents identification label and billboard identification assemblies, wherein the labels provide a series of indicia identifying a plurality of different spices, herbs, and/or other contents. The indicia would be representative of commonly available spices, herbs, and the like.

In accordance with a variant of the present invention, the invention consists of a bottle contents identifying system comprising:

a bottle container;

a bottle cap removably attachable to the bottle in a manner to seal the bottle when closed and obtain access to contents within the bottle when removed;

a bottle contents identification assembly comprising:

an identifier base element, the identifier base element having a peripheral edge, a contents identification wrap extending from the peripheral edge of the identifier base element, wherein a longitudinal axis of the contents identification wrap is substantially perpendicular to a radius between a centroid of the identifier base element and a point of intersection between the contents identification wrap and the peripheral edge of the identifier base element, identification wrap indicia disposed upon an exterior surface of the contents identification wrap, wherein the identification wrap indicia identifies contents of the bottle, wherein the identifier base element is attached to a top surface of the cap of the bottle and the contents identification wrap is secured to a sidewall surface of the cap.

In a second aspect, the bottle contents identification assembly further comprises:

a billboard hingeably attached to the identifier base element; and billboard indicia disposed upon at least one surface of the billboard, wherein the billboard indicia identifies contents of the bottle, In another aspect, the contents identification wrap has a wrap length extending between a first longitudinal end and a second longitudinal end, wherein the wrap length is substantially equal to a circumferential length of the sidewall surface of the cap.

In yet another aspect, the contents identification wrap further comprises a first bonding section located at a first end and a second bonding section located at a second, opposite end.

In yet another aspect, the contents identification wrap includes an adhesive applied to an interior surface.

In yet another aspect, the contents identification wrap has a wrap length extending between like ends of the first bonding section and the second bonding section, wherein the wrap length is substantially equal to a circumferential length of the sidewall surface of the cap.

In yet another aspect, the bottle contents identification assembly contains two contents identification wraps, one contents identification wrap being located being located on an opposite quadrant of the identifier base element than the second contents identification wrap.

In yet another aspect, the bottle contents identification assembly contains two contents identification wraps, each of the contents identification wraps having a wrap length is substantially equal to half of the circumferential length of the sidewall surface of the cap.

In yet another aspect, the bottle contents identification assembly contains identification wrap indicia identifying the contents of the bottle in at least one location thereon.

In yet another aspect, the bottle contents identification assembly contains two contents identification wraps and the identification wrap indicia identifying the contents of the bottle in two locations thereon, one on each contents identification wrap.

In yet another aspect, the first bonding section and second bonding section comprise a mechanical fastener for joining the first bonding section and second bonding section to one another.

In yet another aspect, the first bonding section comprises an adhesive.

In a first method of identifying contents of a bottle, the method comprises steps of:

obtaining a bottle having contents therein, the bottle comprising:

a container, the container defining an interior volume for storing contents, and a bottle cap removably attachable to the container in a manner to seal the container when closed and obtain access to contents within the interior volume of the container when removed;

identifying contents within the interior volume of the container;

obtaining a contents identifier assembly, the contents identifier assembly comprising at least one of:

(a) a contents identification wrap adapted to be attached to a sidewall of the bottle cap, indicia applied to the contents identification wrap wherein the indicia identifies the contents of the interior volume of the bottle container, and (b) a contents identification billboard extending vertically from a contents identifier substrate, the contents identifier substrate being adapted to be attached to a top surface of the bottle cap, indicia applied to the contents identification billboard wherein the indicia identifies the contents of the interior volume of the bottle container; and joining the contents identifier assembly to the bottle cap, wherein the indicia is visible from a side elevation view of the bottle.

In a second aspect, the contents identifier assembly comprises the following:

(a) a contents identification billboard extending vertically from a contents identifier substrate, the contents identifier substrate being adapted to be attached to a top surface of the bottle cap, indicia applied to the contents identification billboard wherein the indicia identifies the contents of the interior volume of the bottle container;

(b) a contents identification wrap adapted to be attached to a sidewall of the bottle cap, indicia applied to the contents identification wrap wherein the indicia identifies the contents of the interior volume of the bottle container, and In another aspect, the contents identifier assembly comprises the contents identification wrap adapted to be attached to a sidewall of the bottle cap, the method further comprising a step of:

joining the contents identifier assembly to the sidewall of the bottle cap, wherein the indicia is visible from a side elevation view of the bottle.

In another aspect, the contents identifier assembly comprises the contents identification billboard extending vertically from the contents identifier substrate, the method further comprising a step of:

joining the contents identifier assembly to the top surface of the bottle cap, wherein the indicia is visible from a side elevation view of the bottle.

In yet another aspect, the contents identification billboard is rotationally assembled to the contents identifier substrate, the method further comprising a step of:

rotating the contents identification billboard from an orientation being substantially parallel to a surface of the contents identifier substrate to an orientation being substantially perpendicular to the surface of the contents identifier substrate.

In yet another aspect, the contents identifier assembly further comprising a contents identifier billboard support leg, the method further comprising a step of:

positioning the contents identifier billboard support leg contents to support the identification billboard in the orientation being substantially perpendicular to the surface of the contents identifier substrate.

In yet another aspect, the contents identification wrap is fabricated of an elastic material, the method further comprising steps of:

stretching the elastic material of the contents identifier assembly;

placing the stretched contents identifier assembly about a circumference of the sidewall of the bottle cap; and retaining the contents identifier assembly about a circumference of the sidewall of the bottle cap by properties of the elastic material.

In yet another aspect, the contents identifier assembly further comprising an adhesive applied to an adhesive section located proximate one end thereof, the method further comprising steps of:

exposing the adhesive applied to the adhesive section of the contents identifier assembly;

circumscribing the contents identifier assembly around the sidewall of the bottle cap;

bonding the adhesive to a second end of the contents identifier assembly; and retaining the contents identifier assembly to the sidewall of the bottle cap by friction.

In yet another aspect, the method further comprises a step of:

applying the indicia to at least one of the contents identification wrap and the contents identification billboard in accordance with at least one of:

pre-applied by a manufacturer, applied by adhering a label to the at least one of the contents identification wrap and the contents identification billboard, and manually writing the contents identification on the at least one of the contents identification wrap and the contents identification billboard.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Detailed embodiments of the present invention are disclosed herein. It will be understood that the disclosed embodiments are merely exemplary of the invention that may be embodied in various and alternative forms. The figures are not necessarily to scale, and some features may be exaggerated or minimized to show details of particular embodiments, features, or elements. Specific structural and functional details, dimensions, or shapes disclosed herein are not limiting but serve as a basis for the claims and for teaching a person of ordinary skill in the art the described and claimed features of embodiments of the present invention. The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims.

Figure 1:
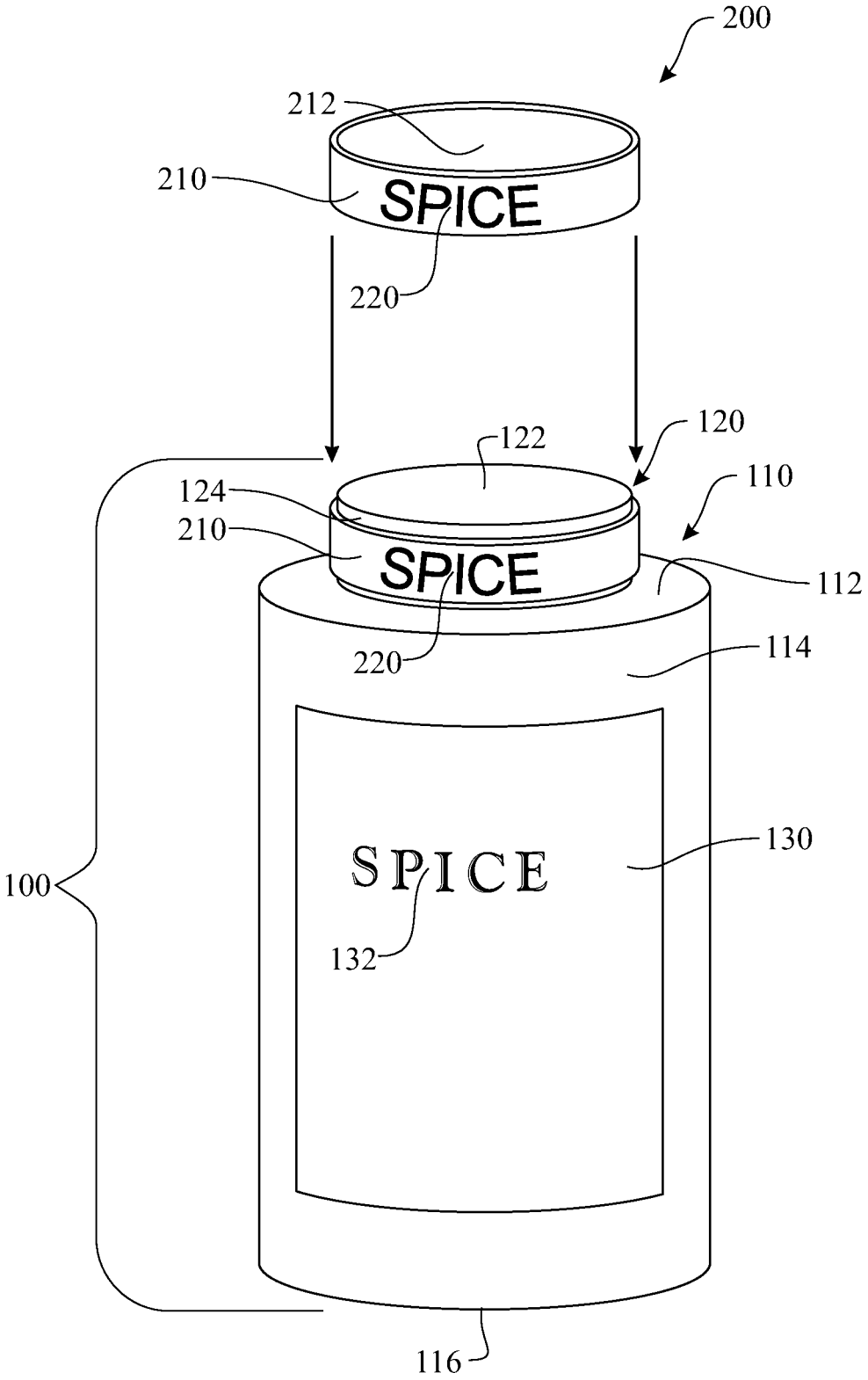
FIG. 1 presents an isometric view of a first exemplary bottle content identification label being attached to an exemplary cap of an exemplary bottle, wherein the first exemplary bottle content identification label is fabricated in a form factor of a loop.

For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Bottles are used to hold and distribute fluids and bulk volumes of small items, such as fluids, spices, herbs, and many other similar items. Bottles 100 are manufactured in a multitude of shapes and sizes, with the most common shape having a cylindrically shaped sidewall 114, a planar or slightly concave bottom wall 116 and a threaded neck extending upward from a bottle top surface 112 for receiving a bottle cap 120, as shown in the exemplary embodiments presented in FIGS. 1, 2, and 4. Contents are deposited within an interior volume of the bottle 110. The bottle 110 is sealed by rotationally securing the bottle cap 120 to the threaded neck of the bottle top surface 112. The bottle cap 120 includes a bottle cap sidewall 124 extending downward from a circumferential edge of a bottle cap top surface 122. Threading is formed on an interior surface of the bottle cap sidewall 124. An exterior surface of the bottle cap sidewall 124 can include one or more features to enhance a grip to the user to aid in sealing and removal of the bottle cap 120 to and from the bottle 110. Examples of the grip enhancing features include texturing, knurling, ribbing, a non-circular shape, and the like.

Contents of the spice bottle assembly 100 are identified by spice identifier indicia 132 applied to a bottle label 130. The bottle label 130 is adhered to an exterior surface of the bottle sidewall 114 of the bottle 110. There are many circumstances where the spice identifier indicia 132 may not be readable by an individual. The spice identifier indicia 132 may be rotated away from a viewing orientation. The spice identifier indicia 132 may be concealed by another spice bottle assembly 100. The spice bottle assembly 100 may be placed upon a shelf located above eye level of the individual, wherein the shelf would block the view of the spice identifier indicia 132.

A spice identifier loop 200, shown in FIG. 1, introduces a first solution for enhancing labeling of the spice bottle assembly 100. The exemplary spice identifier loop 200 is fabricated in a circular shape, having a spice identifier loop exterior surface 210 and a spice identifier loop interior surface 212. The peripheral length of the spice identifier loop interior surface 212 would be the same or slightly shorter than a peripheral length surrounding the exterior surface of the bottle cap sidewall 124. The spice identifier loop 200 can be fabricated of any suitable material. In one variant, the spice identifier loop 200 can be manufactured of a flexible, non-stretch material, such as paper, cardboard, flexible plastic, and the like. In this variant, the peripheral length of the spice identifier loop interior surface 212 would be the same as the peripheral length surrounding the exterior surface of the bottle cap sidewall 124. The spice identifier loop 200 would be adhered to the bottle cap sidewall 124. In a second variant, the spice identifier loop 200 can be manufactured of a flexible material having elastic properties, such as rubber, silicone, and the like. In this variant, the peripheral length of the spice identifier loop interior surface 212 would be slightly shorter as the peripheral length surrounding the exterior surface of the bottle cap sidewall 124. The spice identifier loop 200 would be stretched and the difference in sizes would retain the spice identifier loop 200 upon the bottle cap sidewall 124. A spice identifier indicia 220 would be provided upon the spice identifier loop exterior surface 210. The spice identifier indicia 220 can be provided upon the spice identifier loop exterior surface 210 using any of a variety of the methods. One exemplary process would be by providing a recess extending inward from the spice identifier loop exterior surface 210. A second exemplary process would be by providing a boss extending outward from the spice identifier loop exterior surface 210. A third exemplary process would be by printing an image upon the spice identifier loop exterior surface 210. Although the spice identifier indicia 220 is shown as a single identifier, it is understood that multiple copies of the spice identifier indicia 220 can be spatially provided about the spice identifier loop exterior surface 210 of the spice identifier loop 200. The spice identifier indicia 220 can be applied to the spice identifier loop exterior surface 210 in accordance to at least one of: (a) pre-applied by a manufacturer; (b) applied by adhering a label to the at least one of the contents identification wrap and the contents identification billboard; (c) manually writing the contents identification on the at least one of the contents identification wrap and the contents identification billboard; or any other suitable method.

Although FIG. 1 illustrates a configuration where the spice identifier loop 200 is placed about the bottle cap sidewall 124, it is understood that the spice identifier loop 200 can be placed about an upper region of the bottle sidewall 114, surrounding a neck of the bottle 110, or any other suitable location of the spice bottle assembly 100.

Figure 2:
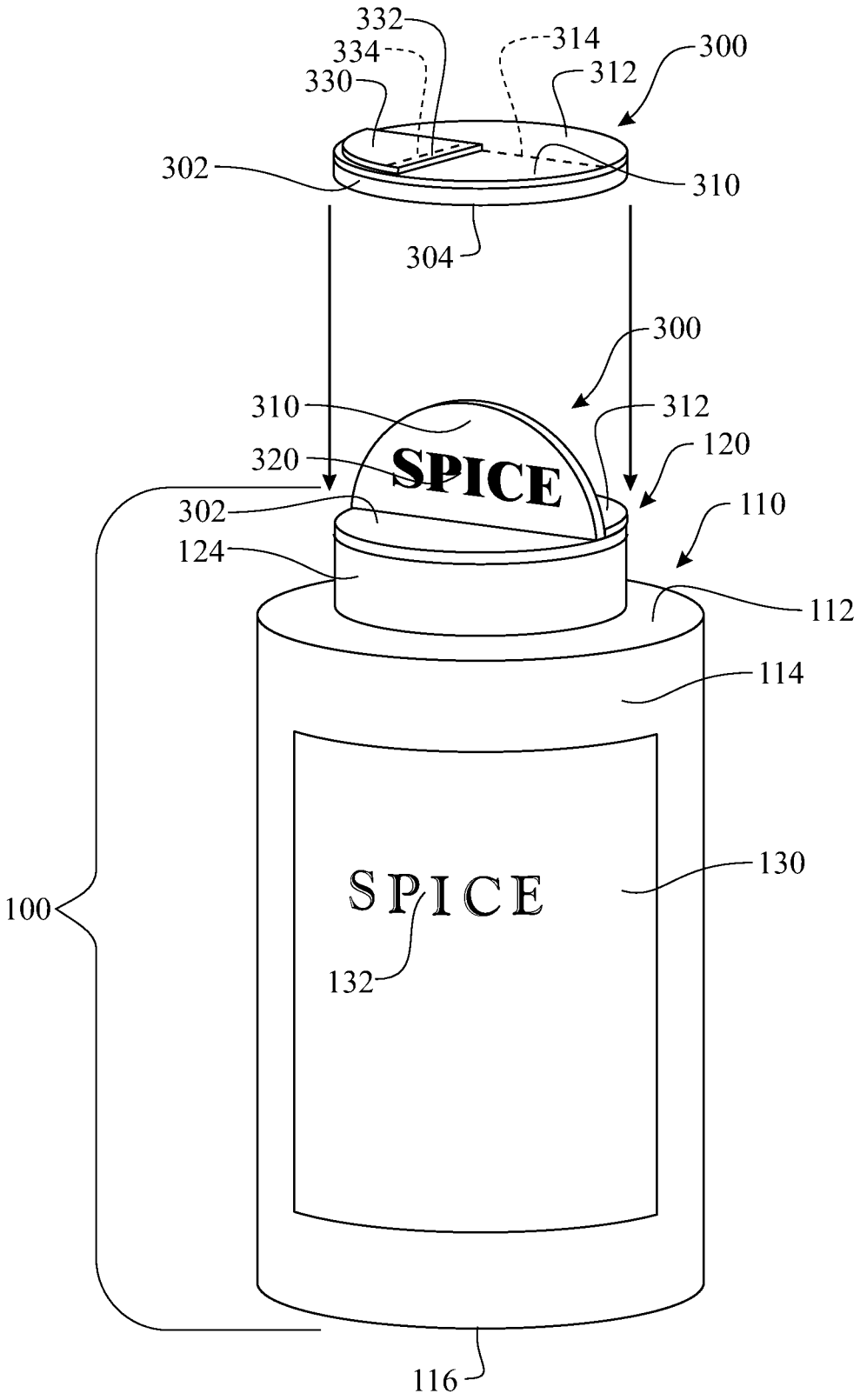
FIG. 2 presents an isometric view of a second exemplary bottle content identification label being attached to an exemplary cap of an exemplary bottle, wherein the second exemplary bottle content identification label is fabricated in a form factor of a billboard.
Figure 3A:
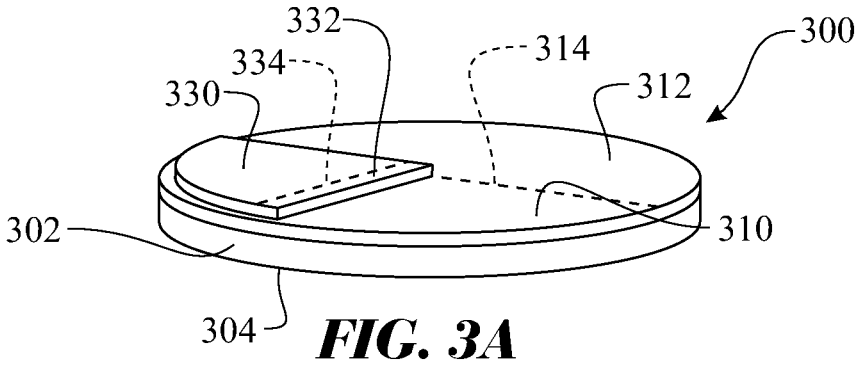
FIG. 3A presents an isometric view of the second exemplary bottle content identification label introduced in FIG. 2, wherein the second exemplary bottle content identification label is shown in a collapsed configuration.
Figure 3B:
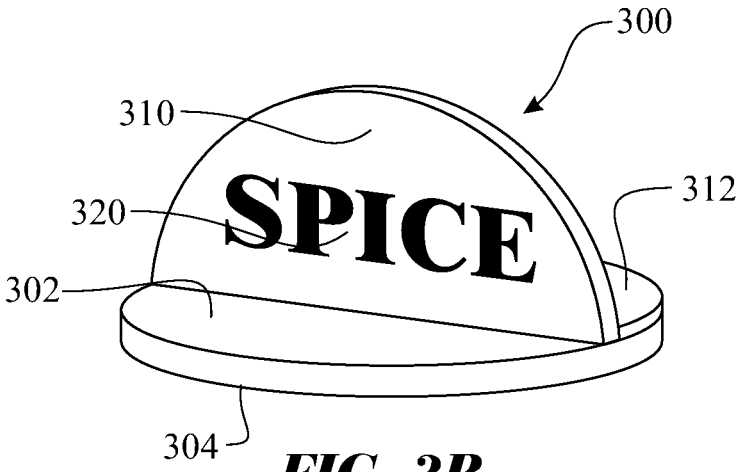
FIG. 3B presents an isometric view of the second exemplary bottle content identification label introduced in FIG. 2, wherein the second exemplary bottle content identification label is shown in a deployed configuration.
Figure 3C:
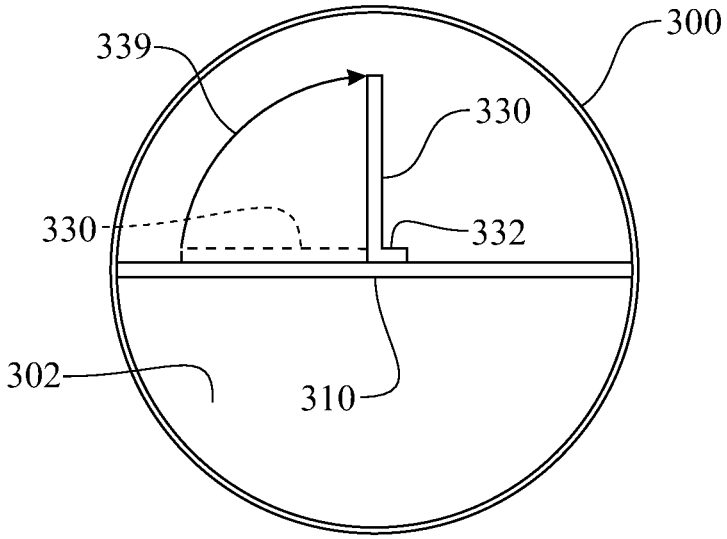
FIG. 3C presents a top plan view of the second exemplary bottle content identification label introduced in FIG. 2, wherein the second exemplary bottle content identification label is shown in a deployed configuration.

A spice identifier tab assembly 300, introduced in FIG. 2 and detailed in FIGS. 3A, 3B, and 3C, introduces a second solution for enhancing labeling of the spice bottle assembly 100. The exemplary spice identifier tab assembly 300 includes a spice identifier tab billboard base segment 312 adhered to an exposed surface of a spice identifier tab substrate 302. An adhesive is attached to a substrate adhesive surface 304 of the spice identifier tab substrate 302 for adhering the spice identifier tab assembly 300 to the bottle cap top surface 122 of the bottle cap 120. A contents identification billboard is segmented into a segmented into a billboard base segment 312 and an indicia carrying segment 310. A spice identifier indicia 320 is provided on one or both sides of the indicia carrying segment 310. The spice identifier indicia 320 can be applied by the manufacturer, or the spice identifier indicia 320 can be provided as a series of labels included in a kit, whereby the user would select the appropriate label and adhere the selected label upon one or both surfaces of the indicia carrying segment 310. A indicia carrying segment 310 is foldably or hingeably integrated with the spice identifier tab billboard base segment 312; folding along a spice identifier tab billboard fold crease 314. The indicia carrying segment 310 and spice identifier tab billboard base segment 312 can be fabricated of a single, unitary material, such as a plastic, a paper based material, a foam based material, and the like. The spice identifier tab billboard fold crease 314 can be defined by an adhesive applied between the spice identifier tab billboard base segment 312 and the upper surface of the spice identifier tab substrate 302. The combination of the indicia carrying segment 310 and the spice identifier tab billboard base segment 312 can be manufactured of a material having plastic bending properties, wherein the indicia carrying segment 310 would remain in an upright position when bent along the spice identifier tab billboard fold crease 314. An optional spice identifier tab billboard support leg 330 can be integrated into the spice identifier tab assembly 300, wherein the spice identifier tab billboard support leg 330 supports the indicia carrying segment 310 in an upright position or billboard configuration. The spice identifier tab billboard support leg 330 is foldably or hingeably integrated with a billboard support leg attachment tab 332; folding along a billboard support leg fold crease 334. The billboard support leg attachment tab 332 can be joined to either the indicia carrying segment 310 (as shown) or the spice identifier tab billboard base segment 312. There are several advantages to the configuration where the billboard support leg attachment tab 332 is adhered to the spice identifier tab billboard base segment 312. The application of the spice identifier indicia 320 to the backside of the indicia carrying segment 310 is easier. This configuration enables adhesion of a label comprising the spice identifier indicia 320 to the backside of the spice identifier tab billboard 310.

The spice identifier tab billboard support leg 330 and billboard support leg attachment tab 332 combination can be manufactured of a material having plastic bending properties, wherein the spice identifier tab billboard support leg 330 would remain in an outstanding position when bent along the billboard support leg fold crease 334.

The spice identifier tab assembly 300 would be provided as a series, each spice identifier tab assembly 300 preferably having a different spice identifier indicia 320, identifying a different composition stored within the spice bottle assembly 100. The spice identifier tab assembly 300 would be stored in a collapsed or planar configuration, as shown in FIG. 3*a*, to reduce space. In use, the user would select the appropriate spice identifier tab assembly 300 having a spice identifier indicia 320 that properly identifies the contents within the spice bottle assembly 100. The user spice identifier tab substrate 302 would adhere the bottle cap top surface 122 of the bottle cap 120 to the substrate adhesive surface 304 using the adhesive applied upon the substrate adhesive surface 304. The user would then bend or rotate the indicia carrying segment 310 from a horizontal, planar or stored configuration into an upright, billboard configuration, as best shown in FIG. 3B. If included, the user would then bend or rotate the spice identifier tab billboard support leg 330 into a supporting configuration, wherein the spice identifier tab billboard support leg 330 extends between the indicia carrying segment 310 and the spice identifier tab billboard base segment 312, as best shown in FIG. 3C.

Figure 4:
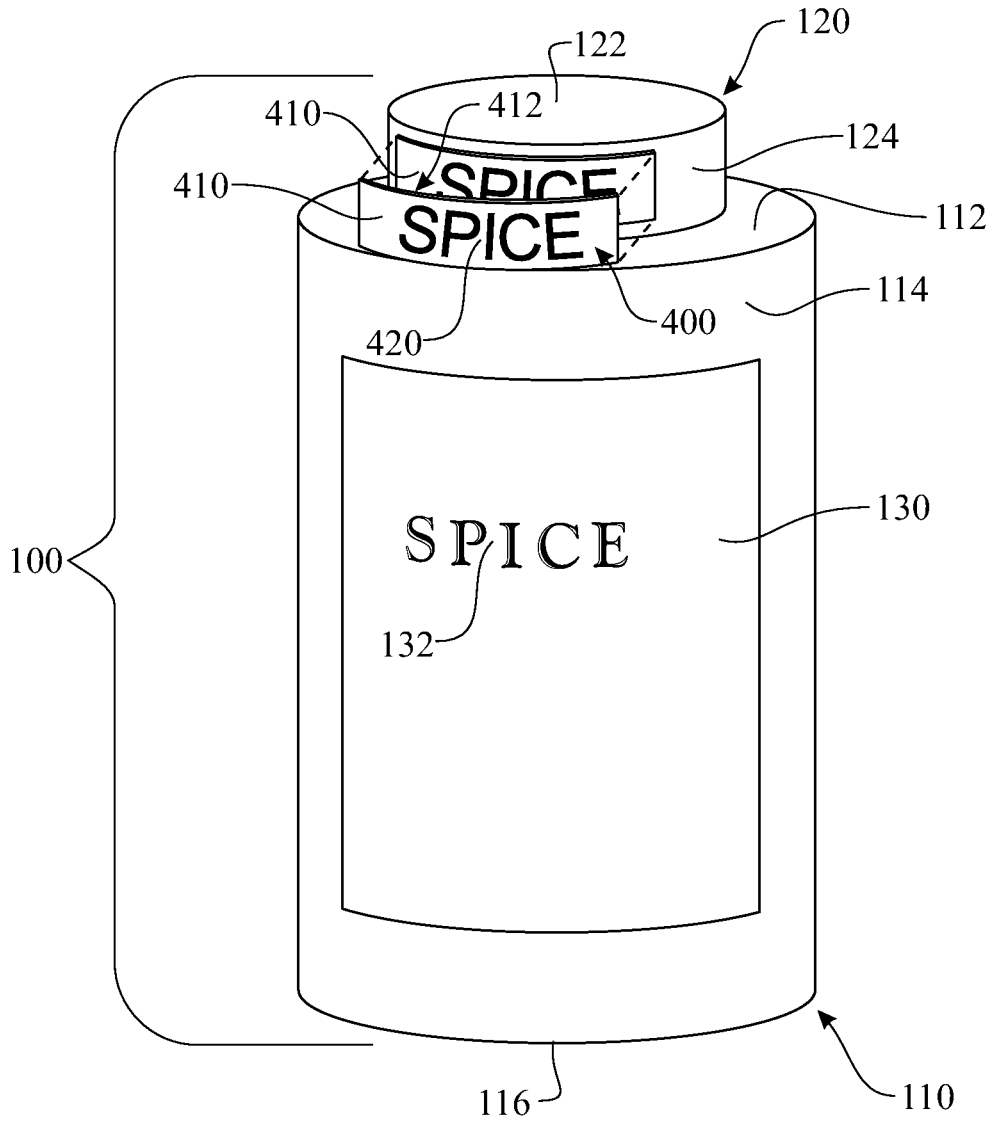
FIG. 4 presents an isometric view of a third exemplary bottle content identification label being attached to an exemplary cap of an exemplary bottle, wherein the third exemplary bottle content identification label is fabricated in a form factor of an adhesively attached label.

A spice identifier label 400, shown in FIG. 4, introduces a third exemplary solution for enhancing labeling of the spice bottle assembly 100. The exemplary spice identifier label 400 is fabricated in a rectangular shape, having a spice identifier label substrate 410 and a label adhesive surface 412. A spice identifier indicia 420 is provided upon the spice identifier label substrate 410. An adhesive or other bonding agent is applied to the label adhesive surface 412. In use, the individual would locate the spice identifier label 400 having the desired spice identifier indicia 420 provided thereon. Once identified, the individual would adhere the spice identifier label 400 to the bottle cap sidewall 124 of the bottle cap 120. It is understood that the spice identifier tab assembly 300 can include a plurality of spice identifier indicia 420 in a spatial arrangement. The inclusion of the plurality of spice identifier indicia 420 reduces an impact of orientation of the spice bottle assembly 100 when stored. The spice identifier label 400 can be cut to a desired length. It is noted that the spice identifier label 400 can be combined with the spice identifier loop 200 and spice identifier tab assembly 300 described above, wherein the spice identifier label 400 would be used as the label replacing the spice identifier indicia 220 and spice identifier indicia 320 respectively.

Figure 5:
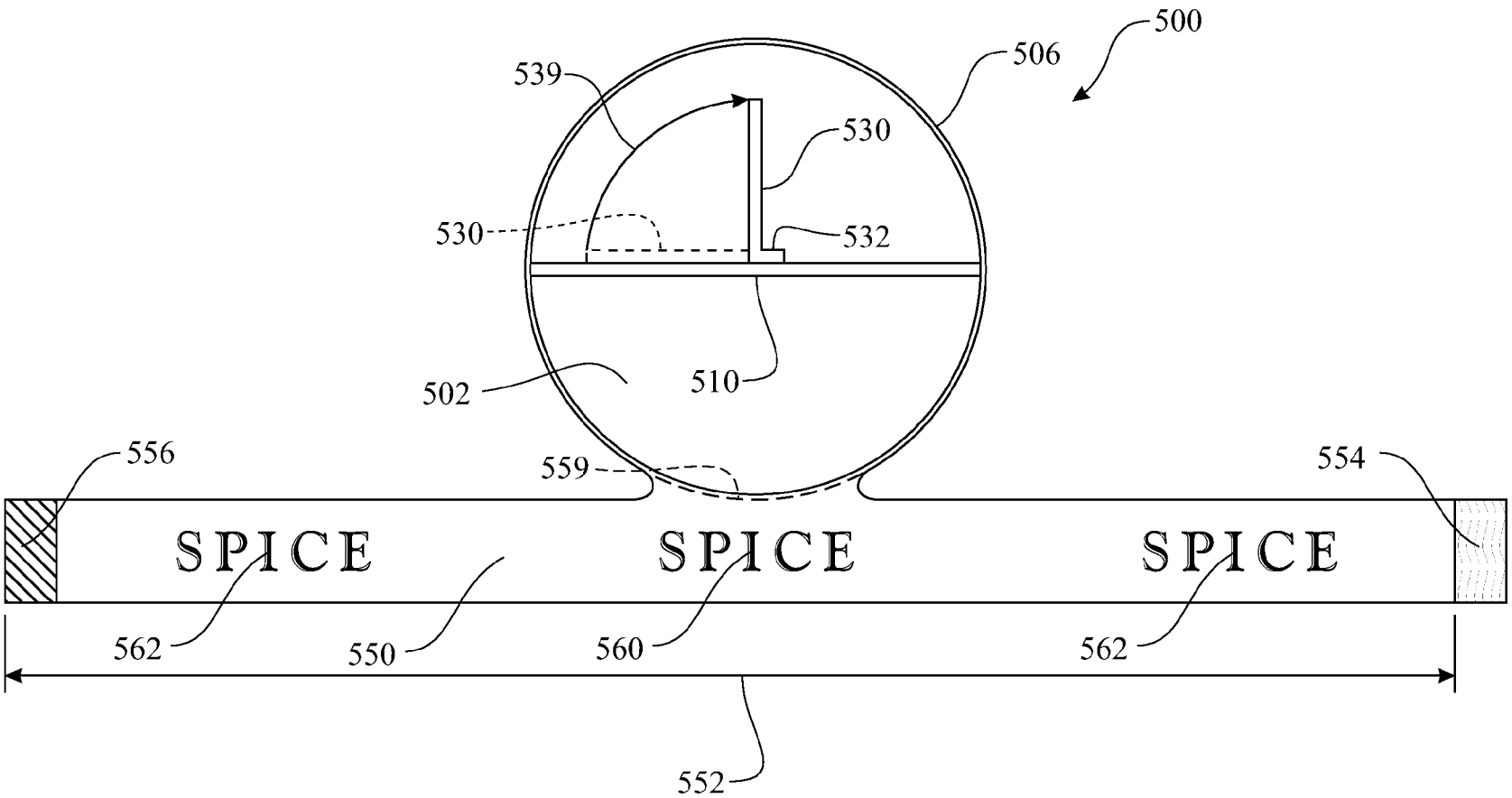
FIG. 5 presents a top plan view of a fourth exemplary bottle content identification system, wherein the fourth exemplary bottle content identification system provides a viewing solution similar to a combination of the first exemplary solution of FIG. 1 and the second exemplary solution of FIGS. 2 and 3.
Figure 6:
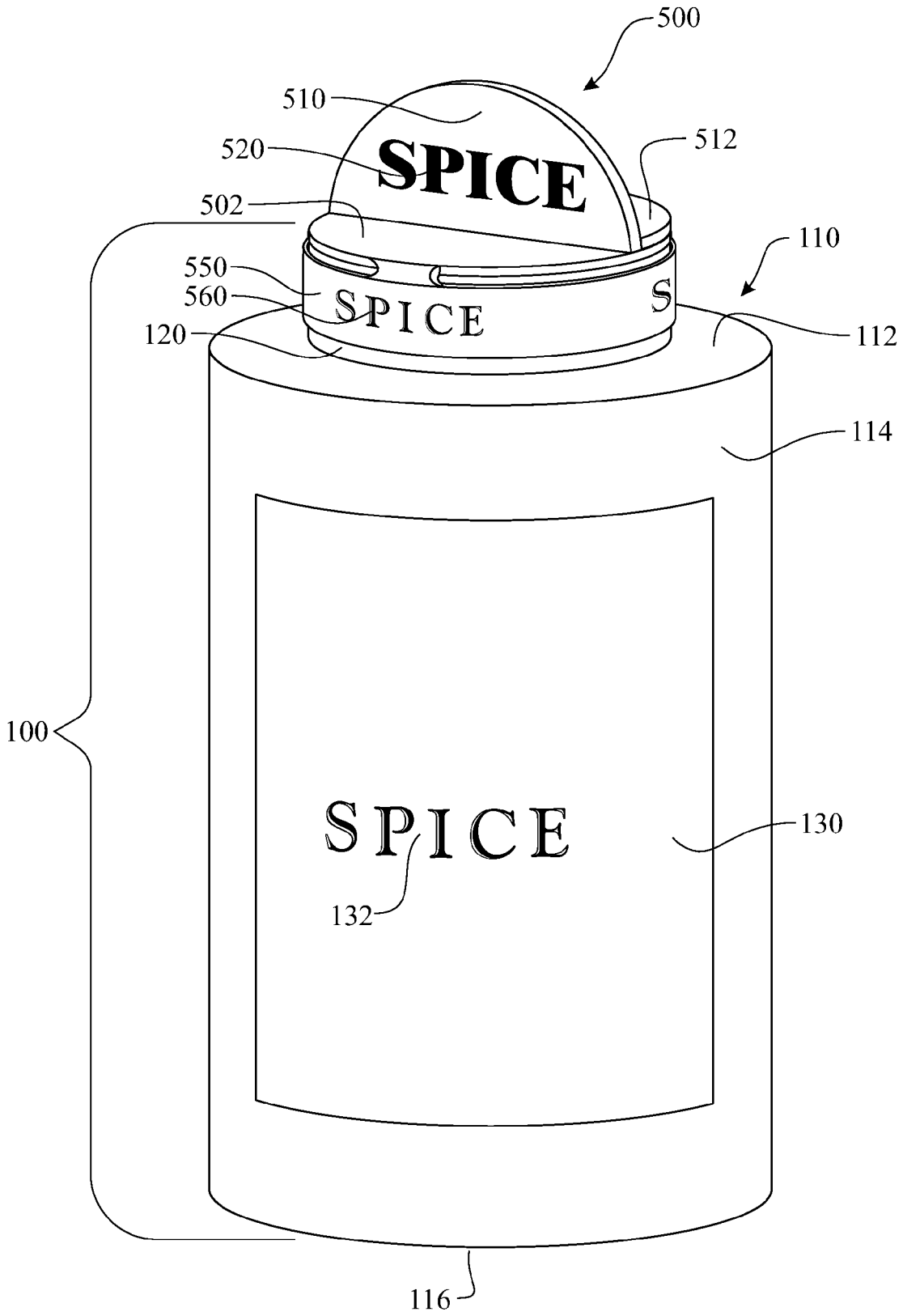
FIG. 6 presents an isometric view of the fourth exemplary bottle content identification system introduced in FIG. 5, wherein the fourth exemplary bottle content identification system is shown in a deployed configuration.

A spice identifier label 500, shown in FIGS. 5 and 6, introduces a fourth exemplary solution for enhancing labeling of the spice bottle assembly 100. The spice identifier tab assembly 500 is an enhanced variant of the spice identifier tab assembly 300, having a number of like elements. Like features of the spice identifier tab assembly 500 and the spice identifier tab assembly 300 are numbered the same except preceded by the numeral '5'. The spice identifier tab assembly 500 can be described as being segmented into two identification features: (a) a spice identifier tab billboard comprising an indicia carrying segment 510 and a billboard base segment 512 and (b) a contents identification wrap 550. It is understood that the spice identifier tab assembly 500 exclusive of the contents identification wrap 550 is the spice identifier tab assembly 300. It is also understood that the spice identifier tab assembly 500 can be fabricated exclusive of the indicia carrying segment 510 and the associated elements thereof.

The contents identification wrap 550 can be an elongated rectangular shaped flexible material joined to the spice identifier tab substrate 502 at a quadrant of a spice identifier tab substrate circumferential edge 506 thereof. A longitudinal direction of the contents identification wrap 550 would be substantially perpendicular to a radial line extending between a centroid of the spice identifier tab substrate 502 and a centralized joint between the contents identification wrap 550 and the spice identifier tab substrate 502. A contents identification wrap circumferential length 552 of the contents identification wrap 550 would be substantially equal to a circumferential length of a spice identifier tab substrate circumferential edge 506 of the spice identifier tab substrate 502.

The contents identification wrap 550 can be secured to the sidewall 124 of the bottle cap 120 using any suitable implementation. In a first implementation, an adhesive can be applied to an interior surface of the contents identification wrap 550. In the first implementation, an overall longitudinal length of the contents identification wrap 550 can be equal to the contents identification wrap circumferential length 552. In a second implementation (as shown), an adhesive can be applied to a first bonding section 554. The first bonding section 554 can have a span that is generally equal to a span of a second bonding section 556 of the contents identification wrap 550. In the second implementation, the overall longitudinal length of the contents identification wrap 550 would be longer than the contents identification wrap circumferential length 552. The contents identification wrap circumferential length 552 can span between an interior edge of the first bonding section 554 and an exterior edge of the second bonding section 556. This configuration results in a circumferential length of the contents identification wrap 550 when the first bonding section 554 and the second bonding section 556 are joined to one another.

A centrally located indicia 560 is applied to an exterior surface of the contents identification wrap 550. It is understood that the contents identification wrap 550 can include one, two, three, or more of the centrally located indicia 560. The exemplary embodiment includes one centrally located indicia 560 and a pair of distally located indicia 562, the indicia 560, 562 are preferably equally spaced from one another when the first bonding section 554 and the second bonding section 556 are joined to one another.

An optional contents identification wrap separation feature 559 can be formed through the material of the spice identifier tab assembly 500, the optional contents identification wrap separation feature 559 being provided between the spice identifier tab substrate 502 and the contents identification wrap 550. The optional contents identification wrap separation feature 559 can aid the user in separating the contents identification wrap 550 from the spice identifier tab substrate 502. This feature enables the user to use the spice identifier tab substrate 502, the contents identification wrap 550, or both. This also allows the user to apply the contents identification wrap 550 to the sidewall 124 of the bottle cap 120 at any suitable location along an axial length thereof.

The contents identification wrap 550 can be secured to the sidewall 124 of the bottle cap 120 using any suitable attachment implementation. The spice identifier tab substrate 502 would be adhered to an upper surface of the bottle cap 120. The contents identification wrap 550 would be secured to the sidewall 124 of the bottle cap 120. In a first implementation, an adhesive can be applied to an interior surface of the contents identification wrap 550. The contents identification wrap 550 would be wrapped around the sidewall 124 of the bottle cap 120 and secured in position by the adhesive. In a second implementation, the contents identification wrap 550 would be wrapped about the circumference of the bottle cap 120. The two ends 554, 556 would be joined together using any suitable joining technique, such as adhesive. The two ends 554, 556 would be located respective to one another tightening the contents identification wrap circumferential length 552 of the contents identification wrap 550 about the circumference of the sidewall 124 of the bottle cap 120.

Figure 7:
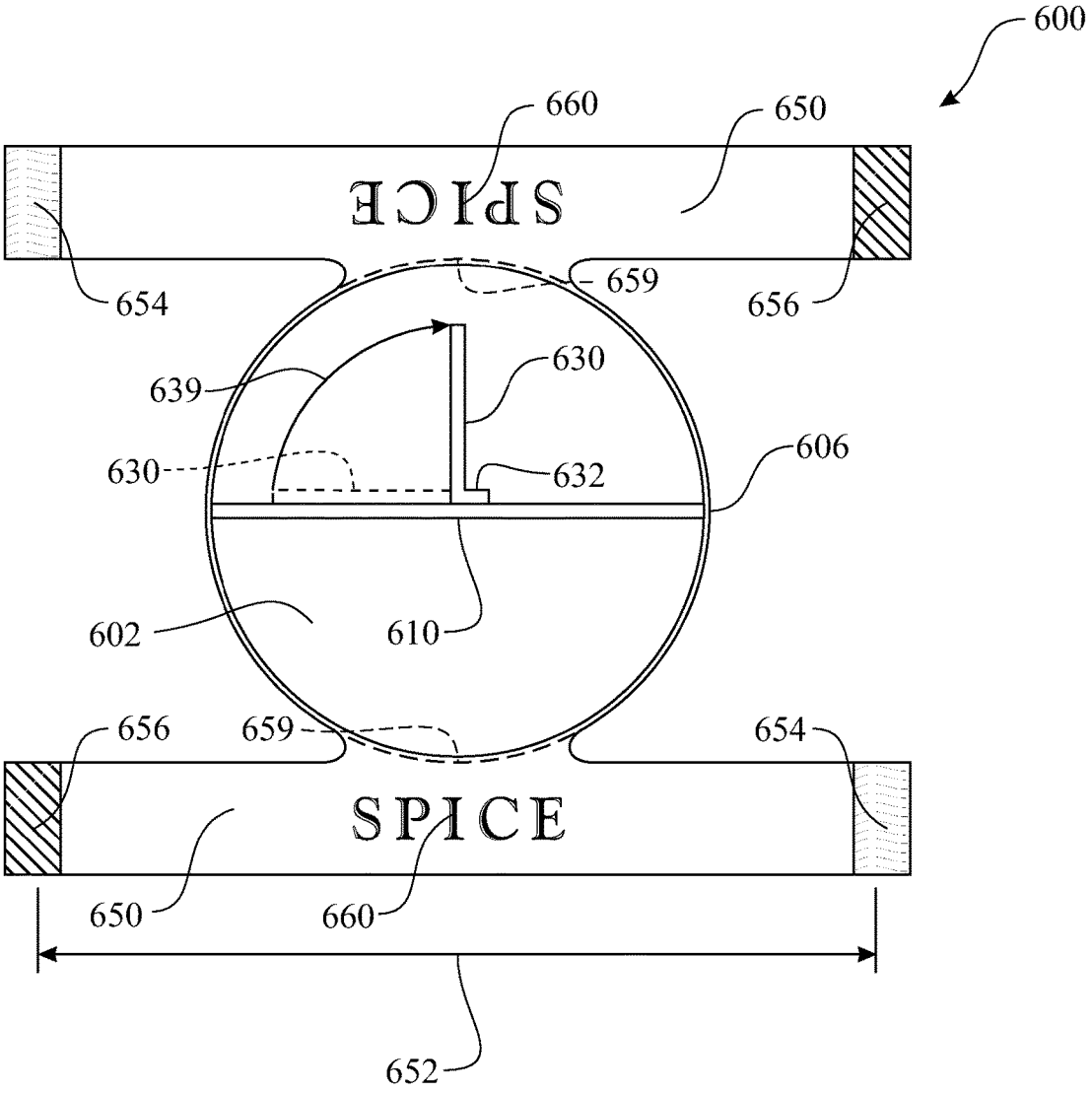
FIG. 7 presents a top plan view of a variant of the fourth exemplary bottle content identification system introduced in FIG. 5.

A spice identifier label 600, shown in FIG. 7, introduces a variant of the fourth exemplary solution for enhancing labeling of the spice bottle assembly 500. The spice identifier tab assembly 600 and the spice identifier tab assembly 500 have a number of like elements. Like features of the spice identifier tab assembly 600 and the spice identifier tab assembly 500 are numbered the same except preceded by the numeral '6'. The distinction between the spice identifier tab assembly 500 and the spice identifier tab assembly 600 is that the spice identifier tab assembly 600 includes a pair of contents identification wrap 650, whereas the spice identifier tab assembly 500 only includes on contents identification wrap 550. A first contents identification wrap 650 and a second contents identification wrap 650 would be arranged being mirror images of one another. A contents identification wrap circumferential length 652 would be one-half of a circumference of the spice identifier tab substrate circumferential edge 606. In one configuration, when installed, a first bonding section 654 of the one of the contents identification wraps 650 would be joined to a second bonding section 656 of the other of the contents identification wraps 650 and a second bonding section 656 of the one of the contents identification wraps 650 would be joined to a first bonding section 654 of the other of the contents identification wraps 650, forming a circumference substantially equal to the circumference of the spice identifier tab substrate circumferential edge 606.

A series of spice identifier tab assemblies 200, 300, 400, 500, 600 can be provided, wherein each of the spice identifier tab assemblies 200, 300, 400, 500, 600 would include an identifier associated with a unique spice or other content. The identifiers can be provided as a series of labels, wherein the user would apply the label with indicia identifying the desired spice or other content onto the respective spice identifier tab assembly 200, 300, 400, 500, 600. In another solution, the user can simply applied the indicia using a permanent marker.

It is also noted that the various identifiers 200, 300, 400, 500, 600 can be color coded to provided additional distinguishing features for easier identification of the desired bottle.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

ELEMENT DESCRIPTION REFERENCES

Ref No. Description

100 spice bottle assembly
110 bottle
112 bottle top surface
114 bottle sidewall
116 bottle bottom wall
120 bottle cap
122 bottle cap top surface
124 bottle cap sidewall
130 bottle label
132 spice identifier indicia
200 spice identifier loop
210 spice identifier loop exterior surface
212 spice identifier loop interior surface
220 spice identifier indicia
300 spice identifier tab assembly
302 spice identifier tab substrate
304 substrate adhesive surface
310 indicia carrying segment
312 spice identifier tab billboard base segment
314 spice identifier tab billboard fold crease
320 spice identifier indicia
330 spice identifier tab billboard support leg
332 billboard support leg attachment tab
334 billboard support leg fold crease
339 support leg rotational motion
400 spice identifier label
410 spice identifier label substrate
420 spice identifier indicia
412 label adhesive surface
500 spice identifier tab assembly
502 spice identifier tab substrate
506 spice identifier tab substrate circumferential edge
510 indicia carrying segment
512 spice identifier tab billboard base segment
520 spice identifier indicia
530 spice identifier tab billboard support leg
532 billboard support leg attachment tab
539 support leg rotational motion
550 contents identification wrap
552 contents identification wrap circumferential length
554 first bonding section
556 second bonding section
559 optional contents identification wrap separation feature
560 centrally located indicia
562 distally located indicia
600 spice identifier tab assembly
602 spice identifier tab substrate
606 spice identifier tab substrate circumferential edge
610 spice identifier tab billboard
612 spice identifier tab billboard base segment
620 spice identifier indicia
630 spice identifier tab billboard support leg
632 billboard support leg attachment tab
639 support leg rotational motion
650 contents identification wrap
652 contents identification wrap circumferential length
654 first bonding section

656 second bonding section
659 optional contents identification wrap separation feature
660 centrally located indicia
662 distally located indicia

What is claimed is:

1. A method of identifying contents of a bottle, the method comprising steps of:

obtaining a bottle having contents therein, the bottle comprising:

a container, the container defining an interior volume for storing contents, and a bottle cap removably attachable to the container in a manner to seal the container when closed and obtain access to contents within the interior volume of the container when removed;

identifying contents within the interior volume of the container;

obtaining a contents identifier assembly, the contents identifier assembly comprising a contents identification billboard segmented into a billboard base segment and an indicia carrying segment, the billboard base segment being carried by a contents identifier substrate, the contents identifier substrate being adapted to be carried by the bottle cap, a support leg pivotally attached to the contents identification billboard, indicia applied to the indicia carrying segment wherein the indicia identifies the contents of the interior volume of the bottle container;

joining the contents identifier assembly to the bottle cap;

rotating the indicia carrying segment from an orientation parallel to the contents identifier substrate to an orientation that is substantially perpendicular to the contents identifier substrate; and positioning the support leg into a position supporting the indicia carrying segment, the resulting support leg defining a plane oriented extending upward from the contents identifier substrate and perpendicular to the indicia carrying segment:

wherein the indicia is visible from a side elevation view of the bottle.

2. A method of identifying contents of a bottle as recited in claim 1, the contents identifier assembly further comprising a contents identification wrap adapted to be attached to a sidewall of the bottle cap, the method further comprising a step of:

joining the contents identifier assembly to the sidewall of the bottle cap.

3. A method of identifying contents of a bottle as recited in claim 1, the method further comprising a step of:

joining the contents identifier assembly to the top surface of the bottle cap.

4. A method of identifying contents of a bottle as recited in claim 1, the method further comprising a step of:

positioning the support leg into a position supporting the indicia carrying segment, the support leg is pivotally attached to the indicia carrying segment the step being accomplished by rotating the support leg about an axis that is perpendicular to a plane defined by the indicia carrying segment.

5. A method of identifying contents of a bottle as recited in claim 1, the method further comprising a step of:

applying the indicia to the indicia carrying segment in accordance with at least one of:

pre-applied by a manufacturer, applied by adhering a label to the at least one of the contents identification wrap and the indicia carrying segment, and manually writing the contents identification on the at least one of the contents identification wrap and the indicia carrying segment.

6. A method of identifying contents of a bottle as recited in claim 1, the contents identifier assembly further comprising a pair of contents identification wraps, each contents identification wrap extending tangentially from an edge of the contents identifier substrate, the method further comprising steps of:

joining adjacent ends of each contents identification wrap with one another forming a loop, the loop being sized to fit around the sidewall of the bottle cap; and locating the loop about the sidewall of the bottle cap.

7. A method of identifying contents of a bottle as recited in claim 6, further comprising indicia applied to at least one of the contents identification wraps of the pair of contents identification wraps, the method further comprising steps of:

viewing the indicia from a side elevation view of the bottle.

8. A method of identifying contents of a bottle as recited in claim 1, the contents identifier assembly further comprising a pair of contents identification wraps, each contents identification wrap being located at opposite quadrants and extending tangentially from an edge of the contents identifier substrate, the method further comprising steps of:

joining adjacent ends of each contents identification wrap with one another forming a loop, the loop being sized to fit around the sidewall of the bottle cap; and locating the loop about the sidewall of the bottle cap.

9. A method of identifying contents of a bottle, the method comprising steps of:

obtaining a bottle having contents therein, the bottle comprising:

a container, the container defining an interior volume for storing contents, and a bottle cap removably attachable to the container in a manner to seal the container when closed and obtain access to contents within the interior volume of the container when removed;

identifying contents within the interior volume, of the container;

obtaining a contents identifier assembly, the contents identifier assembly comprising:

(a) a contents identification billboard extending vertically from a contents identifier substrate, the contents identifier substrate being adapted to be attached to a top surface of the bottle cap, indicia applied to the contents identification billboard wherein the indicia identifies the contents of the interior volume of the bottle container;

(b) a contents identification wrap adapted to be attached to a sidewall of the bottle cap, indicia applied to the contents identification wrap wherein the indicia identifies the contents of the interior volume of the bottle container, and joining the contents identifier substrate to a top surface of the bottle cap, wherein the indicia is visible from a side elevation view of the bottle; and joining the contents identification wrap to a sidewall of the bottle cap, wherein the indicia is visible from a side elevation view of the bottle.

10. A method of identifying contents of a bottle as recited in claim 9, wherein the contents identification billboard is rotationally assembled to the contents identifier substrate, the method further comprising a step of:

rotating the contents identification billboard from an orientation being substantially parallel to a surface of the contents identifier substrate to an orientation being substantially perpendicular to the surface of the contents identifier substrate.

11. A method of identifying contents of a bottle as recited in claim 10, the contents identifier assembly further comprising a contents identifier billboard support leg, the method further comprising a step of:

positioning the contents identifier billboard support leg contents to support the identification billboard in the orientation being substantially perpendicular to the surface of the contents identifier substrate.

12. A method of identifying contents of a bottle as recited in claim 9, the contents identification wrap further comprising an adhesive applied to an adhesive section located proximate one end thereof, the method further comprising steps of:

exposing the adhesive applied to the adhesive section of the contents identification wrap;

circumscribing the contents identification wrap around the sidewall of the bottle cap;

bonding the adhesive to a second end of the contents identification wrap; and retaining the contents identification wrap to the sidewall of the bottle cap by friction.

13. A method of identifying contents of a bottle as recited in claim 9, wherein the contents identifier substrate and the contents identification wrap are fabricated of one unitary sheet of material.

14. A method of identifying contents of a bottle as recited in claim 9, the method further comprising a step of:

applying the indicia to at least one of the contents identification wrap and the contents identification billboard in accordance with at least one of:

pre-applied by a manufacturer, applied by adhering a label to the at least one of the contents identification wrap and the contents identification billboard, and manually writing the contents identification on the at least one of the contents identification wrap and the contents identification billboard.

15. A method of identifying contents of a bottle, the method comprising steps of:

obtaining a bottle having contents therein, the bottle comprising:

a container, the container defining an interior volume for storing contents, and a bottle cap removably attachable to the container in a manner to seal the container when closed and obtain access to contents within the interior volume of the container when removed;

identifying contents within the interior volume of the container;

obtaining a contents identifier assembly, the contents identifier assembly comprising a contents identification billboard segmented along a fold crease into a billboard base segment and an indicia carrying segment, the billboard base segment being carried by a contents identifier substrate, the contents identifier substrate being adapted to be carried by the bottle cap, a support leg pivotally attached to the contents identification billboard, indicia applied to the indicia carrying segment wherein the indicia identifies the contents of the interior volume of the bottle container;

joining the contents identifier assembly to the bottle cap;

rotating the indicia carrying segment from an orientation parallel to the contents identifier substrate to an orientation that is substantially perpendicular to the contents identifier substrate; and positioning the support leg into a position supporting the indicia carrying segment, the resulting support leg defining a plane oriented extending upward from the contents identifier substrate and perpendicular to the indicia carrying segment:

wherein the indicia is visible from a side elevation view of the bottle.

16. A method of identifying contents of a bottle as recited in claim 15, the contents identifier assembly further comprising a contents identification wrap adapted to be attached to a sidewall of the bottle cap, the method further comprising a step of:

joining the contents identifier assembly to the sidewall of the bottle cap.

17. A method of identifying contents of a bottle as recited in claim 15, the method further comprising a step of:

joining the contents identifier assembly to the top surface of the bottle cap.

18. A method of identifying contents of a bottle as recited in claim 15, the method further comprising a step of:

positioning the support leg into a position supporting the indicia carrying segment, the support leg is pivotally attached to the indicia carrying segment the step being accomplished by rotating the support leg about an axis that is perpendicular to a plane defined by the indicia carrying segment.

19. A method of identifying contents of a bottle as recited in claim 15, the method further comprising a step of:

applying the indicia to the indicia carrying segment in accordance with at least one of:

pre-applied by a manufacturer, applied by adhering a label to the at least one of the contents identification wrap and the indicia carrying segment, and manually writing the contents identification on the at least one of the contents identification wrap and the indicia carrying segment.

* * * * *